US005138398A

United States Patent [19]

Yamada

[11] Patent Number: 5,138,398

[45] Date of Patent: Aug. 11, 1992

[54] SUPPORT STRUCTURE HOLDING A PLURALITY OF DEVELOPING DEVICES USED IN A MULTI-COLOR IMAGE FORMING APPARATUS

[75] Inventor: Takanobu Yamada, Toyokawa, Japan

[73] Assignee: Minolta Camera Kabushiki Kaisha, Osaka, Japan

[21] Appl. No.: 619,977

[22] Filed: Nov. 30, 1990

[30] Foreign Application Priority Data

Dec. 4, 1989 [JP] Japan ..... 1-315592

[51] Int. Cl.[5] ..... G03G 15/01

[52] U.S. Cl. ..... 355/326; 355/200; 355/245

[58] Field of Search ..... 355/326, 327, 328, 200, 355/245; 118/645

[56] References Cited

U.S. PATENT DOCUMENTS

| | | | |
|---|---|---|---|
| 4,841,329 | 6/1989 | Kasamura et al. | 355/245 |
| 4,891,672 | 1/1990 | Takagi | 355/245 |
| 4,894,684 | 1/1990 | Nakajima et al. | 355/245 X |
| 4,928,146 | 5/1990 | Yamada | 355/253 |
| 4,937,624 | 6/1990 | Kohtani | 355/245 |
| 4,939,548 | 7/1990 | Yamada et al. | 355/245 |

FOREIGN PATENT DOCUMENTS

| | | | |
|---|---|---|---|
| 204567 | 12/1982 | Japan . | |
| 0244477 | 9/1989 | Japan | 355/326 |
| 0253770 | 10/1989 | Japan | 355/326 |

*Primary Examiner*—A. T. Grimley
*Assistant Examiner*—J. E. Barlow, Jr.
*Attorney, Agent, or Firm*—Burns, Doane, Swecker & Mathis

[57] ABSTRACT

A movable support member which supports a plurality of developing units is moved in reciprocating motion within a range of ordinary movement, and is arranged to be movable until one of the developing units arranged on either end of the plurality of developing units in the direction of reciprocating motion is out of the range of ordinary movement. In such position, it is possible to remove and replace all the developing units because they are all positioned away from a photoconductor and a pressing means which acts to push the units toward the photoconductor. Even in such a position, a lock mechanism is actuated to lock the movable support member.

25 Claims, 5 Drawing Sheets

SUPPORT STRUCTURE HOLDING A PLURALITY OF DEVELOPING DEVICES USED IN A MULTI-COLOR IMAGE FORMING APPARATUS

BACKGROUND OF THE INVENTION

1. Technical Field of the Invention

The present invention relates generally to color image forming apparatus, and more particularly, to a color image forming apparatus wherein a plurality of developing units are arranged and supported on a movable support member in the direction of its reciprocating motion, and each one of the developing units are selectively used by changeably moving them to the position of developing process with reciprocating motion of the movable support member.

2. Brief Description of the Related Art

Such a kind of developing device is disclosed in Japanese Laid-Open Patent Application No. 57-204567. In the device, it is arranged that one of the developing units which does not interfere with a photoconductor during its movement in the course of reciprocating motion is selected and positioned for use at the developing position opposite to the photoconductor. In such a method of changeably positioning the developing units, there is arranged a safety space between the photoconductor and the developing unit which is positioned at the developing position on the course of reciprocating motion in order to prevent interference with each other.

Accordingly, when a developing unit is positioned at the developing position, it is pushed out toward the photoconductor and approaches to the photoconductor to be ready for developing process, while when the developing unit is changed to another one, the pushing action is released to return the developing unit to the course of the reciprocating motion so as not to interfere with the photoconductor.

In an image forming apparatus which is designed for forming a colored image, a balancer is used to balance with gross weight of a movable support member in order to reduce the driving torque which reciprocates the movable support member since three or four developing units are supported on the movable support member and making the gross weight so large.

Periodic maintenance operation is needed to clean the toner powder and its overflow, to remove clogged tone, and to change the developer according to the life of the carrier of a two-component developer. During the maintenance operation, all of the developing units are taken out. It is considered to be rational in this case to take out the developing units from the rear side of the movable support member in view of the supporting mechanism of the movable support member and the developing units, and the guide mechanism in the direction of movement toward and away from the photoconductor on the support member. However, at the rear side of the course through which the developing units reciprocate, there is arranged a pressing means to push out the developing unit positioned at the developing position toward the photoconductor. Accordingly, when the movable support member is moved to the position of any one of the developing units to be operated, the pressing means is positioned at the rear side of said developing unit.

Thus, when all the developing units are taken out, it has heretofore been performed in such a manner that the developing units which are not obstructed by the pressing means are first taken out, and then the developing unit positioned opposite to the pressing means is moved to another position so that it may also be taken out. Such an operation is troublesome and requires much labor.

Moreover, in the case of an apparatus wherein a balancer is activated against a movable support member, the movable support member and the balancer are out of balance by taking out even one developing unit, and the moving force by the balancer acts on the movable support member in accordance with the degree of unbalance. A lock means is, therefore, needed to lock the movable support member at a predetermined position. However, after some of the developing units have been taken out, the lock of the movable support member must be released in order to move the last developing unit to the position where it is removable. In such case, the developing unit is detrimentally forced to move with large force since the balance between the movable support member and balancer was broken by taking out developing units, and making the operation difficult and dangerous.

Conventionally, the movable support member is arranged to be locked only at the number of positions corresponding to the number of developing units, and therefore, when the developing unit on the lowest stage is moved to the developing position, it may happen that the movable support member is not locked completely. In such a case, if one of the developing units is taken out without knowing that, the balance between the movable support member and the balancer will be broken, and the movable support member is moved upward, which eventually causes damage to the main body of image forming apparatus and the like.

Further, the conventional movable support member is arranged to move each one of the developing units only to the developing position, and therefore, one of the developing units is stopped only at the position opposite to the photoconductor. The developing unit facing the photoconductor on the movable support member is released from pressure toward the photoconductor after developing process. However, the release function may be so incomplete that the developing unit and the photoconductor may be kept in close vicinity to each other. Under the circumstances, lumps of toner are stuck to the circumference of a developing roller, potentially causing the toner to scratch the surface of the photoconductor and the developing roller.

SUMMARY OF THE INVENTION

The main object of the present invention is to provide an image forming apparatus which is arranged to easily remove and replace each one of a plurality of developing units.

Another object of the present invention is to provide an image forming apparatus which is capable of having each one of the developing units removed and replaced from the rear side of the support member, capable of feeding toner to a toner hopper connected with each one of the developing units, and capable of easily conducting maintenance operation of the toner hopper.

A further object of the present invention is to provide an image forming apparatus wherein a movable support member, which movably supports each developing unit in reciprocating motion, is actuated by a balancer and lock mechanism to solve the conventional problem of damaging the main apparatus body due to incomplete lock when the movable support member is stopped after a developing process.

These and other objects and features of the present invention will become more apparent from the following description taken in conjunction with the accompanying drawings which illustrate specific embodiments of the invention.

DESCRIPTION OF THE PREFERRED EMBODIMENT

An embodiment of the present invention will now be described below referring to accompanying drawings.

FIGS. 1 through 7 illustrate an embodiment of the present invention which is applied to a color copying machine wherein a plurality of developing units *7b, 7c, 7m* and *7y* are changeably used in an elevation method.

Figure 1:
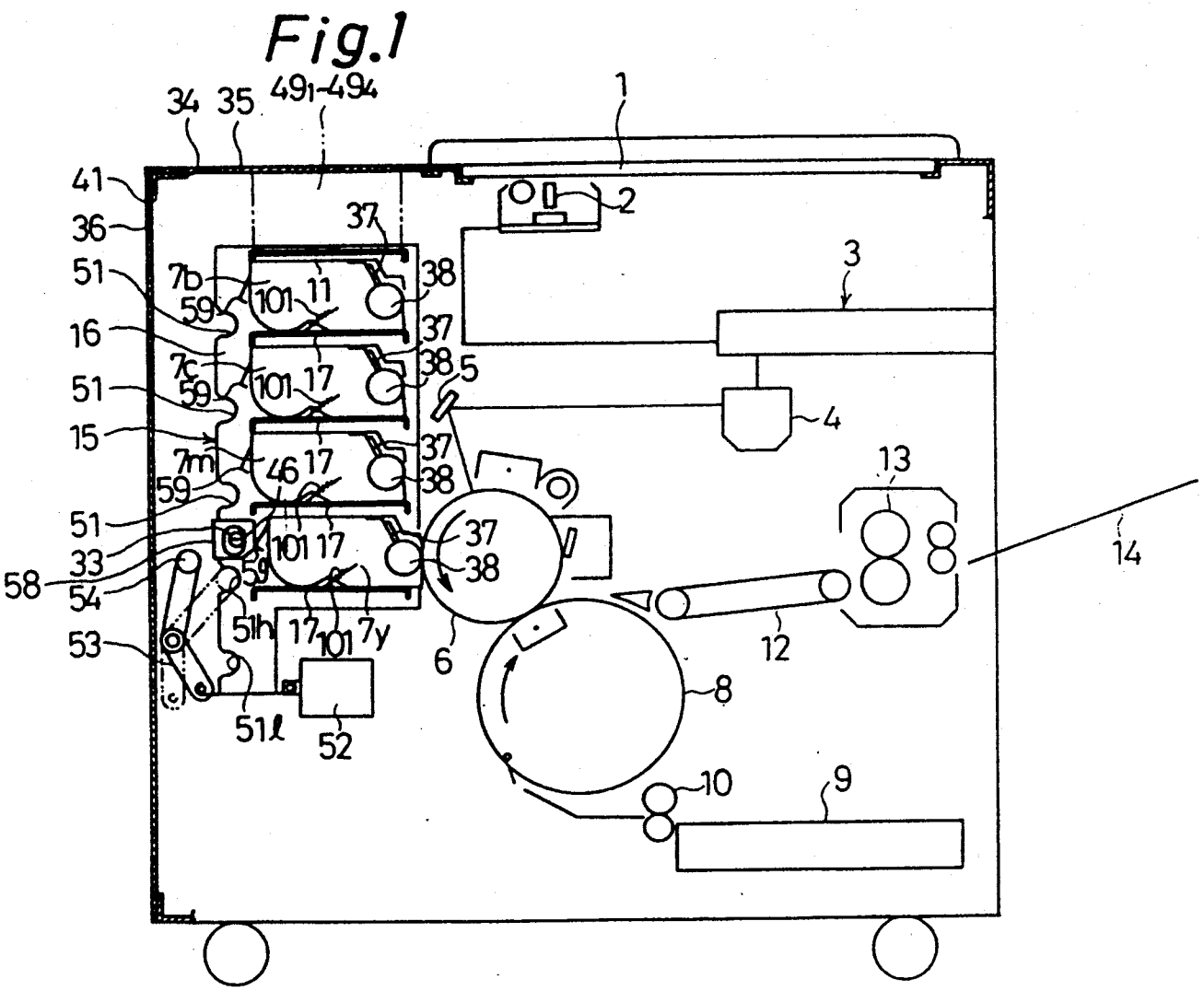
FIG. 1 is the whole structural view showing an example of a copying machine to which the present invention is applied.

FIG. 1 schematically shows the whole structure of the copying machine. A color image of an original placed on an original glass 1 is read as three primary color signals by a CCD line sensor 2. Each color signal is converted into four signals of Y (yellow), M (magenta), C (cyan) and Bk (black) by an image processing circuit and its output signal is transmitted to a laser optical system 3.

From a laser light generating device 4 in the laser optical system 3, laser light for forming images of each color corresponding to signals of the Y, M, C and Bk are successively irradiated through a reflector 5 toward a photoconductive drum 6.

On the surface of the photoconductive drum 6, which rotates in the direction of the arrow in the figure, a latent image is formed by irradiation of the laser light. For the latent image formed corresponding to the signal Y, yellow toner Y is supplied to the photoconductive drum from a developing unit *7y* and a yellow toner image is formed on the photoconductive drum 6. In the same manner, colored toner is supplied to the photoconductive drum 6 from M developing unit *7m*, C developing unit *7c*, and Bk developing unit *7b*, thereby forming magenta toner image, cyan toner image and black toner image successively for the latent image formed corresponding to the signal M, signal C and signal Bk.

A sheet of copy paper fed from a paper cassette 9 and transported by a transport roller 10 is wrapped around a transfer drum 8 which is in contact with the photoconductive drum 6 and which rotates in the direction of the arrow in the figure. Onto the paper wrapped around the transfer drum 8, each colored toner image on the photoconductive drum 6 is successively transferred by rotation of the transfer drum for the required number of times, and a colored toner image composed of toner images in each color is formed. The copy sheet on which a colored toner image is formed is separated from the transfer drum 8 and is then transported by a transfer belt 12 to a fixing roller 13 where the colored toner image is fixed and then discharged onto a discharge tray 14.

The developing units of each color *7y, 7m, 7c, 7b* are vertically supported in multiple stages by an elevation support member 15. Toner replenishing hoppers $49_1$, $49_2$, $49_3$, $49_4$ are arranged on an uppermost stage of the elevation support member 15.

As illustrated in FIG. 1, the elevation support member 15 is provided with a pair of side boards 16, 16, a sheet of toner accommodating hopper support board 11 and four sheets of developing unit support boards 17. The toner accommodating hopper support board 11 supports each one of the toner replenishing hoppers $49_1$, $49_2$, $49_3$, $49_4$, and on each developing unit support board 17 movably supports a developing unit *7y, 7m, 7c, 7b* so that it may be guided forward and backward. Each developing unit is biased by a spring 101 to be at the rear position.

Figure 2:
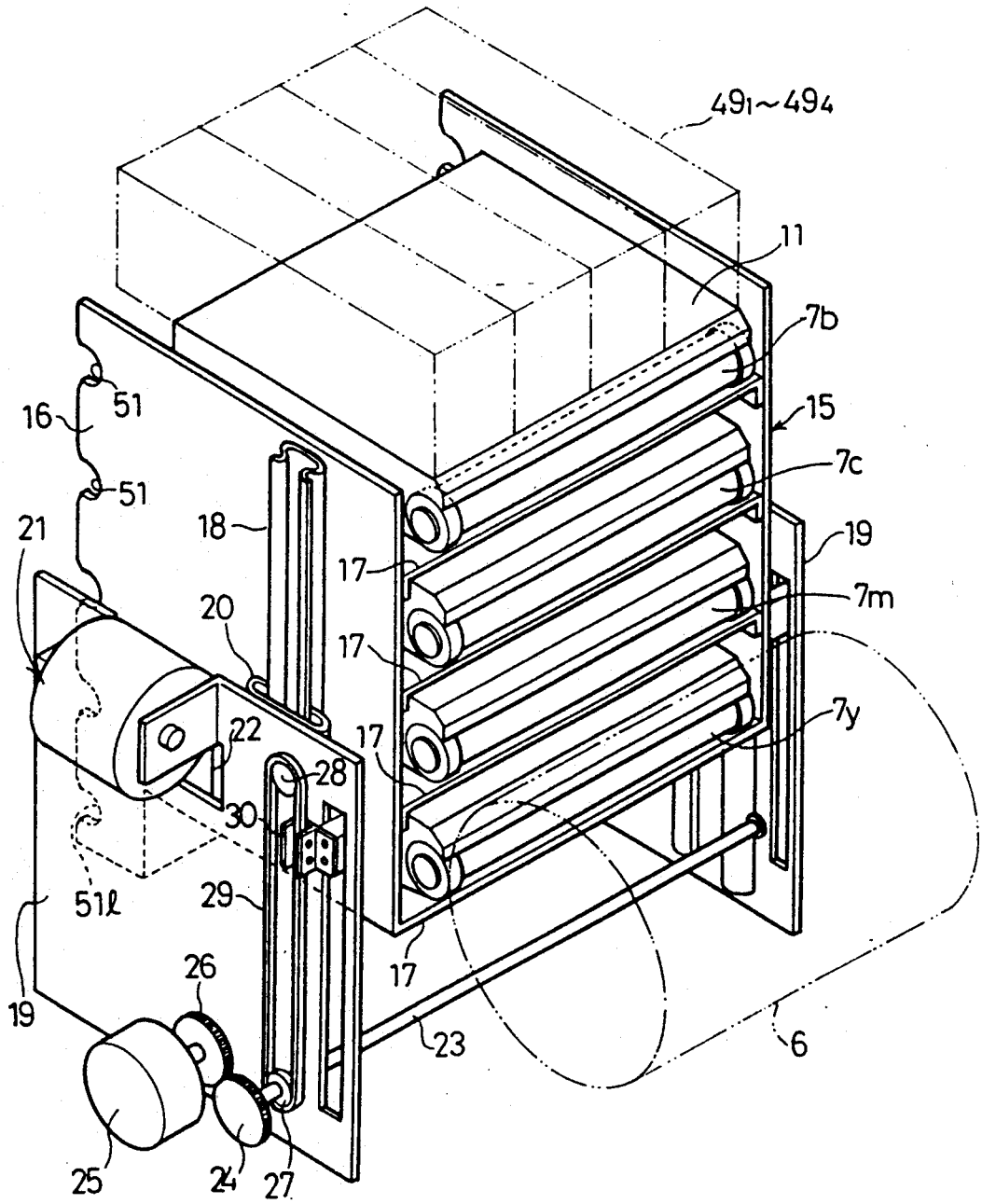
FIG. 2 is a perspective view showing the front side of a developing device of the copying machine as seen from the side of a photoconductor.
Figure 3:
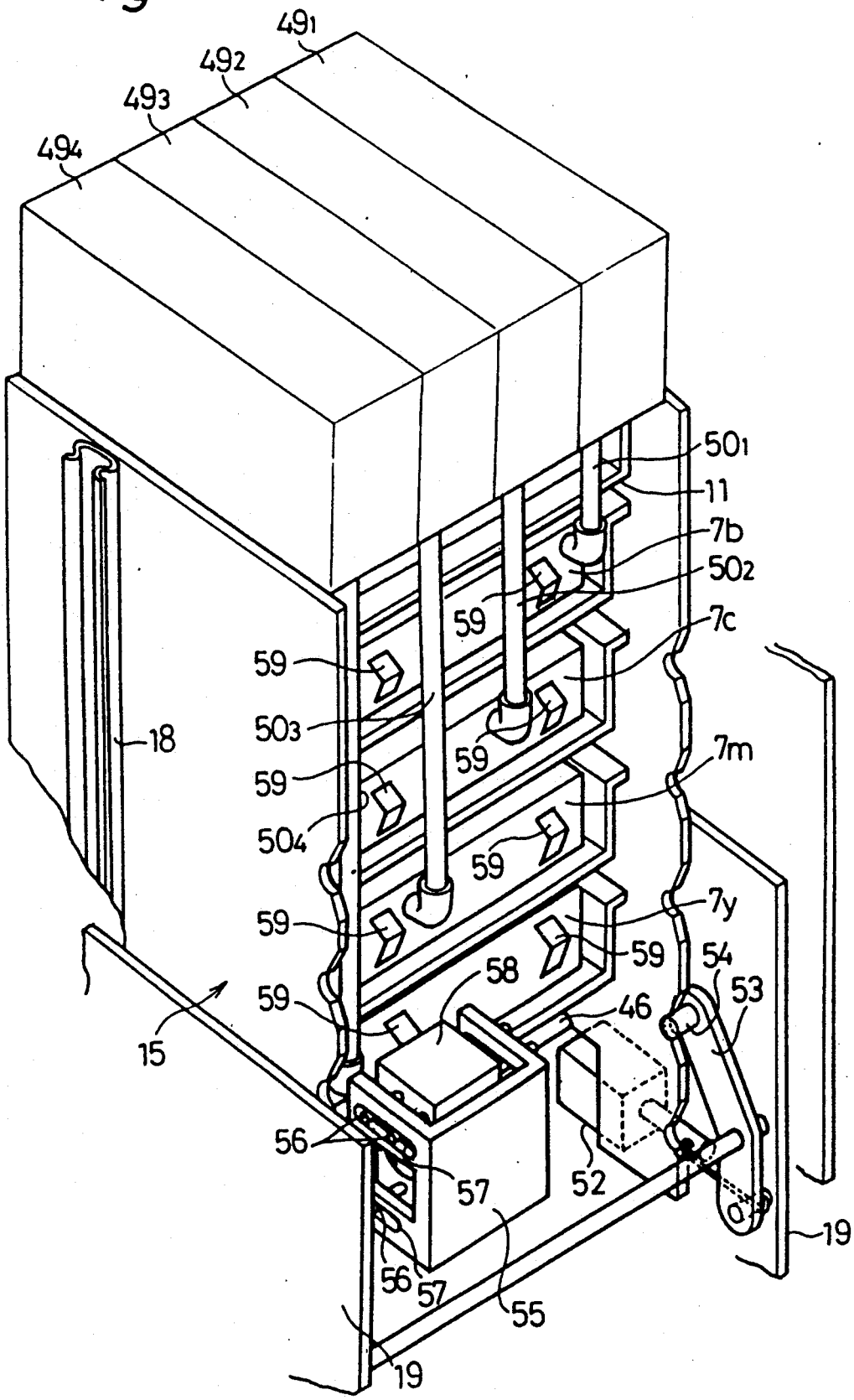
FIG. 3 is a perspective view showing the developing device from the rear side.
Figure 4:
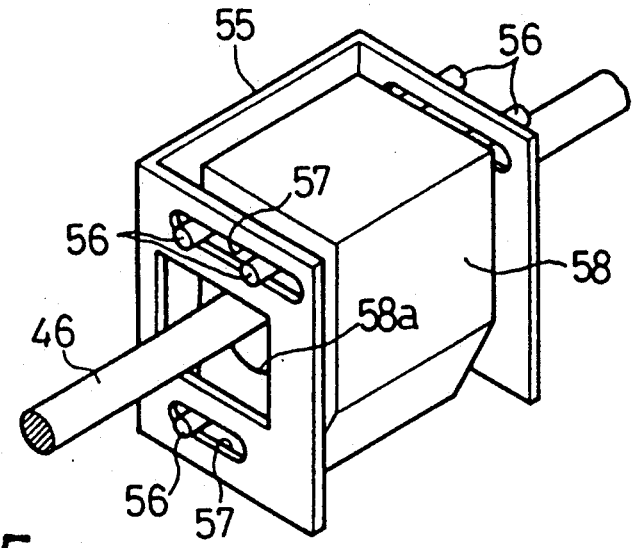
FIG. 4 is a perspective view showing a pressing means to press a developing unit toward the photoconductor.

As shown in FIG. 2, on the outer surface of the sideboard 16, 16 of the elevation support member 15, rails 18 are mounted in the vertical direction and are fitted into rails 20 attached to the inner surface of a pair of stationary boards 19, 19 fixed on the main body of the apparatus. The elevation support member 15 is movably guided in a vertical direction and supported by the stationary boards 19, 19 in a fitting relation between the rails 18 and 20.

A constant force balancer 21 in the form of a leaf spring is mounted on the stationary board 19, and the tip portion of a spring sheet 22 of the balancer 21 is attached to the sideboard 16 of the elevation support member 15. The balancer 21 balances with the gross weight of the elevation support member 15, and is arranged to always maintain a balanced state irrespective of any vertical position of the elevation support member 15.

A driving shaft 23 is hung at the lower portion between the stationary boards 19, 19, and a gear 24 fixed to one end of the shaft is interlocked with a driving gear 26 of a stepping motor 25. Adjacent to both ends of the driving shaft 23, sprockets 27 are fixed. At the positions above the sprockets 27, there are provided sub-sprockets 28 held on the stationary boards 19. A pair of chains 29 are wound around between the sprockets 27 and 28 and connected to the elevation support member 15 with couplers 30. The elevation support member can thus be moved to a predetermined height or position by rotative control of the stepping motor 25.

FIG. 1 shows a state when the Y developing unit *7y* at the lowest stage is placed at the developing position height opposite to the photoconductive drum 6. In order to position the other developing units *7m, 7c, 7b* at the developing position height, the position of the elevation support member 15 may be determined by rotative control of the stepping motor 25. In this embodiment, it is further arranged to move the elevation support member 15 upward to a position where the lowest developing unit *7y* is positioned higher than the developing position height as shown in FIG. 7.

At the rear end of the frame of the elevation support member 15, notched portions 51 are formed for positioning. The notched portions 51 are arranged opposite to each developing unit *7b, 7c, 7m 7y*, and an additional notched portion is further provided thereunder. Behind the elevation support member 15, there is arranged a lock lever 53 which is connected to a solenoid 52. The lock lever 53 is provided on its tip portion with a lock roller 54 which is engaged and disengaged with the notched portions 51. The lock lever 53 is moved to the locked position by the solenoid 52 every time a developing unit *7b, 7c, 7m, 7y* is switched and moved to the developing position height. The lock roller 54 is engaged with the notched portion 51 opposite to the developing unit which is at the developing position height, and the elevation support member 15 is locked. The lock lever 53 is also moved conversely to the unlocked position by the solenoid 52 when each developing unit *7b, 7c, 7m, 7y* is switched and moved.

Figure 7:
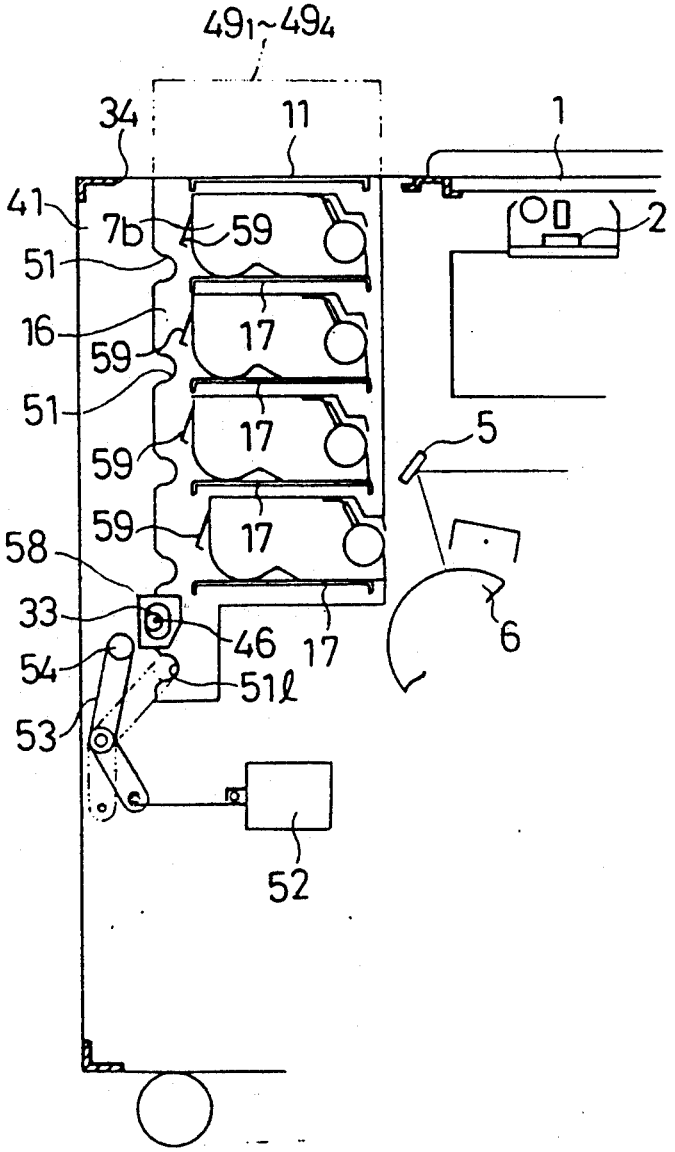
FIG. 7 is a partial structural view of the copying machine showing an elevation support member which supports the developing units being moved upward to the position where the developing units are capable of being taken out.

This unlocking action is also performed when the elevation support member 15 is being switched and moved to the developing unit take-out position shown in the FIG. 7. The lock lever 53 is returned to the lock position once the elevation support member 15 is positioned at the developing unit take-out position. The lock roller 54 is thereby engaged with the lowermost notched portion 51 and the elevation support member 15 is locked at the developing unit take-out position. The home position of the elevation support member 15 is the position where the lowermost developing unit *7y* is at the developing position height as shown in FIG. 1.

Each developing unit *7y, 7m, 7c, 7b* is biased backward to a predetermined retreated position by a spring 101 on the elevation support member 15. Accordingly, even if the elevation support member 15 is moved upward and downward, each developing unit *7y, 7m, 7c, 7b* does not come in contact with nor interfere with the photoconductive drum 6.

In FIG. 1, there is shown a state when the developing unit *7y* is positioned opposite to the photoconductive drum 6 at the developing position height. A pair of cams 33 are provided on the right and left sides to push one of the developing unit *7y, 7m, 7c, 7b* located at the developing position toward the photoconductive drum 6 and bring it in the close vicinity to a predetermined operating location where developing operation can be performed.

As illustrated in FIGS. 1, 3, 4, 5 and 6, each cam 33 is fixed to a cam driving shaft 46 and is positioned in a cavity 58*a* of a moving cam 58, said moving cam being movably supported back and forth by pins 56 and long grooves 57 provided in a stationary frame 55 which is fixed to the main body of the apparatus. When the cam driving shaft 46 rotates, the moving cam 58 slides forward and pushes a developing unit toward the photoconductive drum 6 against the spring 101. The pushing action is then released. The cam driving shaft 46 is rotatively controlled by an unillustrated motor and clutch for properly pushing out the developing unit. At the rear portion of each developing unit *7y, 7m, 7c* and *7b*, there is provided a flat spring 59 to receive the pushing action of the moving cam 58. A developing unit approached to the photoconductive drum 6 is surely stopped at a regulated position by a stopper 60.

Maintenance of the developing units is periodically conducted by a serviceperson to clean toner powder and its overflow, to remove clogging, or to change the developer according to the life of the carrier of a two-component developer. When this maintenance operation is conducted, all of the developing units *7y, 7m, 7c* and *7b* are taken out. In order to take out each developing unit, it is advantageous to take out the developing units from the rear side of the elevation support member 15 where there are fewer obstacles.

However, when the cams 33 are positioned at the rear side of the developing unit *7y* as shown in FIG. 1, the developing unit *7y* can not be taken out since it is obstructed by the cams 33. It is, therefore, arranged to move the elevation support member 15 to the developing unit take-out position. At this position, as illustrated in FIG. 7, each developing unit *7y, 7m, 7c, 7b* is moved one stage above the highest ordinary position of the developing unit so that all the developing units are placed above the cams 33. In this raised position, each developing unit can be taken out without interference by the cams 33. It may also be arranged to move the elevation support member 15 upward by several developing unit stages.

A toner replenishing hose 50 is connected to each developing unit *7b, 7c, 7m, 7y* from the toner accommodating hoppers $49_1$–$49_4$ provided for toner replenishment. When each developing unit *7b, 7c, 7m, 7y* is taken out, the hose is disconnected.

There is no special space provided in the main body of the apparatus for movement of the elevation support member 15 to the developing unit take-out position. However, an opening 34 is provided on the upper surface of the main body for replenishing toner to the toner accommodating hopper. Since the position of the opening 34 corresponds to the elevation support member 15, the elevation support member 15 may be moved upward to the developing unit take-out position by opening a cover 35 to allow the elevation support member 15 to project from the opening 34. By projecting the toner accommodating hopper $49_1$–$49_4$ upwardly through the opening 34 of the main body, the maintenance of the hopper as well as toner supply can be easily conducted.

Each developing unit *7y, 7m, 7c* and *7b* can be taken out by removing a cover 36 arranged at the rear of the main body to expose an opening 41. The elevation support member 15 can be locked at the developing unit take-out position, and each developing unit *7y, 7m, 7c* and *7b* can be taken out at their respective position. Accordingly, even after some developing units are taken out, it is not necessary to release the elevation support member 15 from a locked state and then move it to a different position. Thus, the operation can be conducted easily and safely.

The lower-most notched portion 51*l*, used to lock the elevation support member 15 at the developing unit take-out position, is arranged below the notched portion 51*h* used to lock the elevation support member 15 at the home position. Accordingly, the following advantages can be obtained for safety's sake. Since the elevation support member 15 is returned to the home position after a developing process is over, it is locked at the home position and the apparatus is kept under a state of suspension. However, since the locking operation is often performed at the home position, it sometimes occurs that the locking is not completely carried out. Even if only one of the developing units is taken out for temporary inspection or adjustment without knowing about the incomplete locking, the balance between the elevation support member 15 and the balancer 21 is broken and the elevation support member 15 is moved upward by the force of the balancer 21. The conventional apparatus, however, can not stop such an action, and eventually, it sometimes occurs that the elevation support member 15 hits and damages the upper portion of the main body, for instance, the cover 35.

In this embodiment, in addition to the notched portion 51*h* which locks the elevation support member 15 at the home position, another lower notched portion 51*l* is arranged under said notched portion 51*h* to lock the elevation support member at the developing unit take-out position. Therefore, even if the elevation support member 15 is accidentally moved upward from the home position, the lower-most notched portion 51*l* engages the lock roller 54 of the lock lever 53 as it passes thereby, and the upward movement of the elevation support member 15 above the developing unit take-out position is stopped. The problem inherent in the conventional apparatus as described above can thus be solved.

Maintenance operation of the developing units is periodically conducted. However, in the case when a monocolored image is formed for a multiplicity of sheets by a copying machine provided with a plurality of developing units like the one described in this embodiment, the same developing unit is continuously kept at the developing position. Because the same developing unit is used continuously, the amount of toner to be replenished per unit time is increased corresponding to the consumption of toner. Moreover, it results in an insufficient stir of toner, and a decrease in the amount of toner electrification. Accordingly, a lot of toner powder is produced during the period when the toner passes through a height regulating plate 37 in the developing unit until it is used for developing process on the photoconductive drum 6. The toner powder is accumulated on a cover in a short period of time and then flops down onto a developing sleeve 38. The insufficiently charged toner is then supplied for the developing process and is dropped onto a sheet.

In order to solve the problem, it has heretofore been arranged to provide a guide bar which forms the same height of gap as the developer whose height is regulated on the developing sleeve 38. However, it is quite difficult to properly set the gap without obstructing the transport of developer on the developing sleeve 38. Manufacturing and mounting such a device is expensive, and there may occur problems that the transport of toner is obstructed, and the toner powder can not be prevented.

Figure 5:
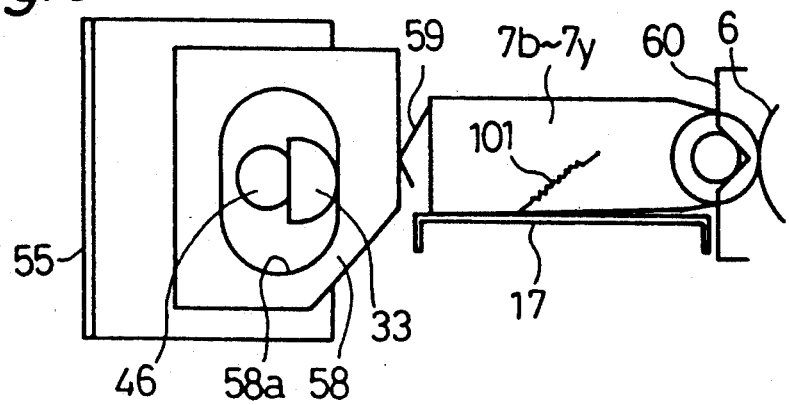
FIG. 5 is a side view showing the developing unit when pushed by the pressing means.
Figure 6:
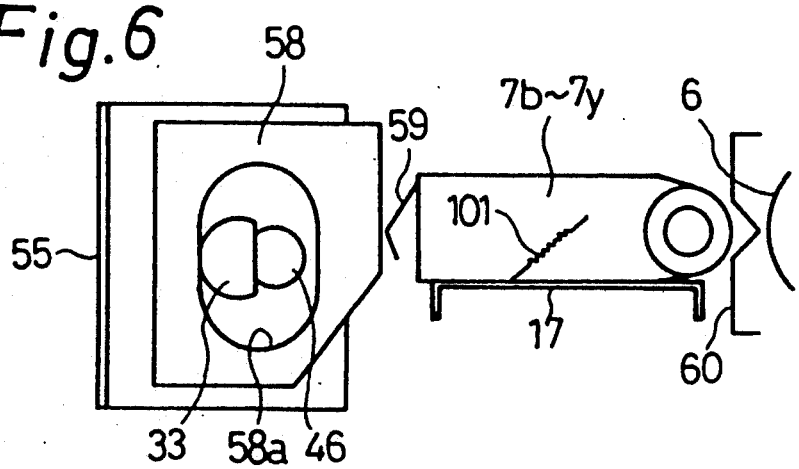
FIG. 6 is a side view showing the developing unit when released from the pushed action.

In this embodiment, a developing unit as shown in FIG. 5 solves the above problem by moving the developing unit toward and away from the photoconductive drum 6 when a monocolor developing process is performed. In this operation, the developing unit which is kept for continuous use is properly moved and vibrated so that the insufficiently stirred and electrified toner is prevented from accumulating on the cover of the developing unit and the accumulated toner is prevented from flopping down.

It is preferable to conduct such a process of moving the developing unit toward and away from the photoconductive drum every time an image forming operation is performed. However, it may also be arranged to conduct the operation every time a predetermined number of image forming operations are performed within the limit that problems do not occur. The same benefit can be obtained when the above operation is applied to a copying machine which includes only one developing unit for forming a monocolored image.

Further, in the above-described embodiment, the home position of the elevation support member 15 may be set at the developing unit take-out position. In this case, every time the elevation support member 15 is returned to the home position, all of the developing units *7y, 7m, 7c, 7b* are retreated from the position opposite to the photoconductive drum 6. With such an arrangement, disadvantages can be solved as in the case when the home position of the elevation support member 15 is such that one of the developing units is arranged opposite to the photoconductive drum 6.

Specifically, in the latter case, when the elevation support member 15 is positioned at the home position, an action for pushing the developing unit which is positioned opposite to the photoconductive drum 6 toward the drum 6 is released as described in the above embodiment. However, if there occurs a bend or elongation of the spring 101, or unusual overhang of the flat spring 59 toward the rear side, the developing unit is not retreated, wholly or partly, even if the pushing action is released. In this case, lumps of toner adhere around the developing sleeve 38 since the developing sleeve 38 of the developing unit is kept in the vicinity of the photoconductive drum 6. The excess toner may stress and ultimately scratch the surfaces of the photoconductive drum 6 and the developing sleeve 38. When no developing unit faces the photoconductive drum at the home position of the elevation support member 15, the above described problem does not occur.

In the above embodiment, description has been made of a color copying machine, however, the present invention may also be applied to a developing device for use in a laser printer. Further, it may be applied not only for a color image forming operation but for all the apparatuses wherein a plurality of developing units are mounted on a movable elevation support member.

The movable elevation support member is not limited to the one which moves in reciprocating motion in the direction of straight line. It may also be applied to the movable elevation support member which reciprocates in the direction of a circular arc. In this case, it may be arranged to provide a developing unit take-out position of the movable support member by projecting either one of the developing units arranged on both ends of the movable support member in the direction of its reciprocating motion outside an ordinary range of movement of the movable support member.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus having a plurality of developing units each of which accommodates different colored developers for developing an electrostatic latent image on a photoconductive member comprising:

supporting means for detachably supporting said developing units and being capable of reciprocating movement integrally therewith for selectively positioning one of said developing units at a developing position defined along a plane where the developing unit is brought into developing contact with said photoconductive member, wherein said developing units are arranged in the direction of the reciprocating movement; and moving means for moving said support means to a position where all of said developing units are out of said developing position.

2. The image forming apparatus as claimed in claim 1, wherein the supporting means reciprocates in the vertical direction.

3. The image forming apparatus as claimed in claim 1 further comprising lock means for locking said support means at a desired position.

4. The image forming apparatus as claimed in claim 1 further comprising balance means for balancing with said supporting means and said developing units, wherein a balanced state is maintained at any position of said supporting means.

5. The image forming apparatus as claimed in claim 1 further comprising push means for bringing the developing unit positioned at the developing position toward the photoconductive member so as to intermittently actuate the developing unit to supply developer onto the photoconductive member.

6. An image forming apparatus having a plurality of developing units each of which accommodates a different colored developer for developing an electrostatic latent image on a photoconductive member comprising:

supporting means for detachably supporting said developing units and being capable of reciprocating integrally therewith for selectively positioning one of said developing units at a developing position where developer is supplied onto the photoconductive member for developing the electrostatic latent image, wherein said developing units are arranged in the direction of the reciprocating movement; and lock means capable of engaging with engaging means provided on the supporting means for locking the supporting member at a desired position, wherein said engaging means comprises a plurality of first engaging portion, each first engaging portion corresponding to a developing units and a second engaging portion which corresponds to no developing unit.

7. The image forming apparatus as claimed in claim 6, wherein said supporting means reciprocates in the vertical direction.

8. The image forming apparatus as claimed in claim 6 further comprising balance means for balancing with said supporting means provided with said developing units, wherein a balanced state is maintained at any position of said supporting means.

9. The image forming apparatus as claimed in claim 6 further comprising push means for bringing the developing unit positioned at the developing position toward the photoconductive member so as to intermittently actuate the developing unit to supply developer onto the photoconductive member.

10. An image forming apparatus having a plurality of developing units which accommodate different colored developers respectively for developing an electrostatic latent image on a photoconductive member, said image forming apparatus comprising:

supporting means for detachably supporting said developing units and being capable of reciprocating movement integrally therewith for selectively positioning one of the developing units at a developing position defined along a plane where the developing unit is brought into developing contact with said photoconductive member, wherein said developing units are arranged in the direction of the reciprocating movement;

lock means for locking said supporting means at a desired position;

balance means for balancing with said supporting means provided with the developing units wherein a balanced state is maintained at any position of said supporting means; and moving means for moving said supporting means to a retracted location where all of said developing units are retracted from said developing position, said supporting means being locked at said retracted location by said lock means.

11. The image forming apparatus as claimed i claim 10, wherein the support member reciprocates in the vertical direction.

12. The image forming apparatus as claimed in claim 10, wherein said supporting means further comprising engaging portions for engaging with said lock means so as to lock said supporting means at a desired position and each of said developing unit corresponds to a part of said engaging portions.

13. The image forming apparatus as claimed in claim 10 further comprising push means for bringing the developing unit positioned at the developing position toward the photoconductive member so as to intermittently actuate the developing unit to supply developer onto the photoconductive member.

14. An image forming apparatus having a plurality of developing units containing developer and which may be selectively positioned so as to provide developer to a photoconductive member, comprising:

reciprocating support means for detachably supporting and reciprocating said plurality of developing units, said plurality of developing units arranged adjacent to one another in a first direction of reciprocation, said plurality of developing units being movably spaced from said photoconductive member in a second direction substantially perpendicular to said first direction;

first moving means for reciprocating said support means in said first direction to bring a selected one of said plurality of developing units into a developing position defined along a plane where the developing unit is brought into developing contact with said photoconductive member; and second moving means for moving said selected developing unit in said second direction and into close proximity to said photoconductive member whereby said selected developing unit may provide developer to said photoconductive member; p1 said first moving means being capable of reciprocating said plurality of developing units to a detachment position where all of said developing units are out of the developing position to facilitate detachment of all of said developing units without the necessity of further reciprocating said first moving means.

15. The image forming apparatus of claim 14, wherein said first direction of reciprocation and the arrangement of said developing units is vertical.

16. The image forming apparatus of claim 14 further comprising:

lock means for locking said reciprocating support means at a desired position.

17. An image forming apparatus having a plurality of detachable developing units which may be placed in a developing position to provide developer to a photoconductive member and having an obstacle that hinders the detachment of a developing unit that is in the developing position, comprising:

support means for detachably supporting said developing units; and moving means for selectably moving said support means to position a selected one of said developing units in the developing position and for selectably moving said support means to a detachment position where all of said developing units are clear of said obstacle so that all of said developing units may be detached without repositioning said support means.

18. The image forming apparatus of claim 17 further comprising:

lock means for locking said support means at a desired position.

19. The image forming apparatus of claim 17 further comprising:

pushing means for intermittently pushing said selected developing unit into engagement with said photoconductive member so as to provide developer thereto.

20. An image forming apparatus having a plurality of detachable developing units which may be placed in a developing position defined along a plane where a developing unit is brought into developing contact with a photoconductive member, comprising:

support means for detachably supporting said developing units;

moving means for selectably moving said support means to position a selected one of said developing units in the developing position and for selectably moving said support means to a detachment position where all of said developing units may be detached without repositioning said support means;

first lock means for locking said support means when said selected developing unit is at the developing position; and second lock means for stopping movement of said support means if said first lock means should fail.

21. The image forming apparatus of claim 20 further comprising third lock means for locking said support means when said support means is at the detachment position.

22. The image forming apparatus of claim 21, wherein said second lock means and said third lock means are same.

23. The image forming apparatus of claim 20 further comprising:

pushing means for intermittently pushing said selected developing unit into engagement with said photoconductive member so as to provide developer thereto.

24. The image forming apparatus of claim 20 further comprising:

balance means for providing a balancing force to said support means at any position thereof.

25. The image forming apparatus of claim 20:

wherein said support means is comprised of a stationary portion and a moving portion, said moving portion supporting said developing units;

wherein said first and second lock means are jointly comprised of an engagement means provided on said stationary portion for locking engagement with a plurality of cooperating engagement portions provided on said moving portion;

wherein said first lock means further comprises a first plurality of said cooperating engagement portions, each of said first plurality of cooperating engagement portions which engage said engagement means to lock one of said developing units in the developing position; and wherein said second lock means is further comprised of a cooperating engagement portion which engages said engagement means to lock said support means in the detachment position.

* * * * *